US008366215B2

(12) United States Patent
Chen

(10) Patent No.: US 8,366,215 B2
(45) Date of Patent: Feb. 5, 2013

(54) STABILIZING ASSEMBLY OF DRAWABLE CARRIER

(76) Inventor: Tsung Yao Chen, Zhuqi Township, Chiayi County (TW)

( * ) Notice: Subject to any disclaimer, the term of this patent is extended or adjusted under 35 U.S.C. 154(b) by 281 days.

(21) Appl. No.: 12/755,501

(22) Filed: Apr. 7, 2010

(65) Prior Publication Data

US 2010/0283365 A1 Nov. 11, 2010

(30) Foreign Application Priority Data

May 5, 2009 (TW) ..... 98114779 A

(51) Int. Cl.
*A47B 88/00* (2006.01)

(52) U.S. Cl. ..... 312/331; 312/334.6

(58) Field of Classification Search ..... 312/331, 312/334.1, 334.6–334.8, 334.4, 334.27, 350, 312/402, 404, 311
See application file for complete search history.

(56) References Cited

U.S. PATENT DOCUMENTS

| | | | | |
|---|---|---|---|---|
| 1,380,688 | A * | 6/1921 | Sweeney | 312/323 |
| 2,620,253 | A * | 12/1952 | Read et al. | 312/331 |
| 3,323,853 | A * | 6/1967 | Stark | 312/331 |
| 4,600,254 | A * | 7/1986 | Whalen | 312/323 |
| 7,430,937 | B2 * | 10/2008 | Rotter et al. | 74/422 |
| 7,594,707 | B2 * | 9/2009 | Kunkle et al. | 312/402 |
| 7,677,125 | B2 * | 3/2010 | Rotter | 74/422 |
| 2008/0314067 | A1 * | 12/2008 | Lee | 62/441 |
| 2009/0248205 | A1 * | 10/2009 | Yu et al. | 700/275 |
| 2011/0210655 | A1 * | 9/2011 | Brown et al. | 312/334.8 |
| 2012/0038255 | A1 * | 2/2012 | Netzer et al. | 312/319.1 |

FOREIGN PATENT DOCUMENTS

| | | | |
|---|---|---|---|
| CN | 200910008402.5 | | 1/2009 |
| DE | 202004016393 | U1 | 12/2005 |
| EP | 1036526 | A1 | 9/2000 |
| EP | 1913842 | A1 | 4/2008 |

* cited by examiner

*Primary Examiner* — Janet M Wilkens
(74) *Attorney, Agent, or Firm* — Alan Kamrath; Kamrath IP Lawfirm, P.A.

(57) ABSTRACT

A stabilizing assembly includes a retaining device settled between a drawable carrier and a cabinet body for preventing the drawable carrier from swinging in sliding. The retaining device includes two rails fixed to two opposite laterals of the drawable carrier. Each of the rails has a rack. Two gears engaging with the racks are connected by a rod and rotate simultaneously. Two bushes connected to two ends of the rod are received in supporting seats that are fixed on the cabinet body or the drawable carrier and allowed to shift vertically. Two stop portions, as a stop unit, each extending from the rail toward a side of the rod opposite to another side of the rod facing the rack on the rail, are closely adjacent to the retained portions so that the bushes are retained and stopped by the stop unit, and disengagement between the racks and the gears is prevented.

8 Claims, 7 Drawing Sheets

STABILIZING ASSEMBLY OF DRAWABLE CARRIER

FIELD OF THE INVENTION

The present invention relates to a structural assembly for orienting and stabilizing a drawable carrier so as to not only prevent the drawable carrier from sliding bias and swinging but also eliminate noise caused by jogging or disengaging gears when the drawable carrier is pushed or drawn to slide.

BACKGROUND OF THE INVENTION

Generally, between a cabinet body and a drawer installed therein, there are drawer slides composed of sliding rails and sliding guides for easy and smooth slide of the drawer inward or outward the cabinet body. However, since sliding rails and sliding guides are usually assembled with intervals of considerable width therebetween, when a pulling or pushing force is exerted on any point of the drawer except the center of the facade of the drawer, the drawer slides bias, leading to abnormal operation and thus wear of the drawer, eventually reducing the service life of the drawer.

For remedying this problem, the inventor of the present invention proposed an invention that has been filed in China as China Patent Application No. CN200910008402. Therein, in addition to drawer slides that guide a drawable carrier to slide in or out a cabinet body, the prior art device, at two laterals of the drawable carrier, has row holes (functioning as two lateral racks) or fixed components formed with row holes that are aligned along the sliding direction of the drawable carrier, and has an engaging assembly that includes a rod having two ends equipped with gears, wherein the gears engage with the corresponding row holes on the bottom of the drawable carrier, and the rod is supported by two seats fixed to the cabinet body, which seats each has a spring to prop up the rod, so that the upward pushing force the springs exert on the rod ensures proper engagement between the gears at the to ends of the rod and the row holes.

By the technical means of the prior art-device, when the drawable carrier is drawn or pushed to slide, even if the force exerting point is not right at the center of the facade of the drawable carrier, the limitation provided by the mutually engaging gears and the row holes, which ensures the gears to move along the row holes without derailment, maintains the sliding direction of the drawable carrier without deviation. However, when the drawable carrier, especially in the case where the drawable carrier is a large drawer, is drawn or pushed at one of its lateral edge of its facade furthest from the center and thus received an extremely transversely unbalanced force, the gears are liable to escape from the row holes, causing the drawable carrier to seriously slant to one side and become aberrant. Such aberration not only brings about sliding noise, but also leads to accelerative wear of the gears and the row holes, or, even forces the two side gears to jump out of the row holes, incurring damage to the structural components.

SUMMARY OF THE INVENTION

For preventing disengagement and noise between the slide guide and the drawable carrier, the present invention provides a retaining device settled between a cabinet body and a drawable carrier. The retaining device prevents the drawable carrier from sliding bias and causing noise due to jogging or disengaging gears in sliding of the drawable carrier.

The technical approach adopted by the present invention for solving the technical problems of the prior art device lies on a retaining device arranged between a cabinet body and a drawable carrier for guiding slide. The retaining device includes rails that are settled between the cabinet body and two laterals of the drawable carrier and have racks extending along the sliding direction of the drawable carrier, and a rolling shaft composed of a rod, two gears at two ends of the rod for properly engaging with the racks without the risk of biasing, wherein two bushes are connected to two ends of the rod and fittingly received in two corresponding supporting seats and each said bush is formed with a retained portion near the corresponding gear, and a stop unit on the rail toward the rod opposite to the rack on the rail and being closely adjacent to and separated from the rod by a predetermined distance.

The present invention is advantageous as it orientates the sliding drawable carrier and improves operational noise. Since the inventive device uses engagement between the bushes and the rod to orientate the gears on the racks instead of the springs propping up the rod in the prior-art device, the smoothness and operational noise can be improved. Also, in virtue of the radial limitation the stop unit provides to the bushes, eliminates disengagement between the gears and racks even when the drawable carrier receives an unbalanced drawing or pushing force while ensuring smooth and stable slide of the drawable carrier, and preventing sliding noise and jogging.

In addition to orienting and stabilizing the sliding drawable carrier, the present invention also, in virtue of the radial limitation the stop unit provides to the bushes, eliminates disengagement between the gears and racks even when the drawable carrier receives an unbalanced drawing or pushing force while ensuring smooth and stable slide of the drawable carrier, and preventing sliding noise and jogging.

BRIEF DESCRIPTION OF THE DRAWINGS

The invention as well as a preferred mode of use and advantages thereof will be best understood by referring to the following detailed description of illustrative embodiments in conjunction with the accompanying drawings, wherein.

DETAILED DESCRIPTION OF THE INVENTION

Figure 1:
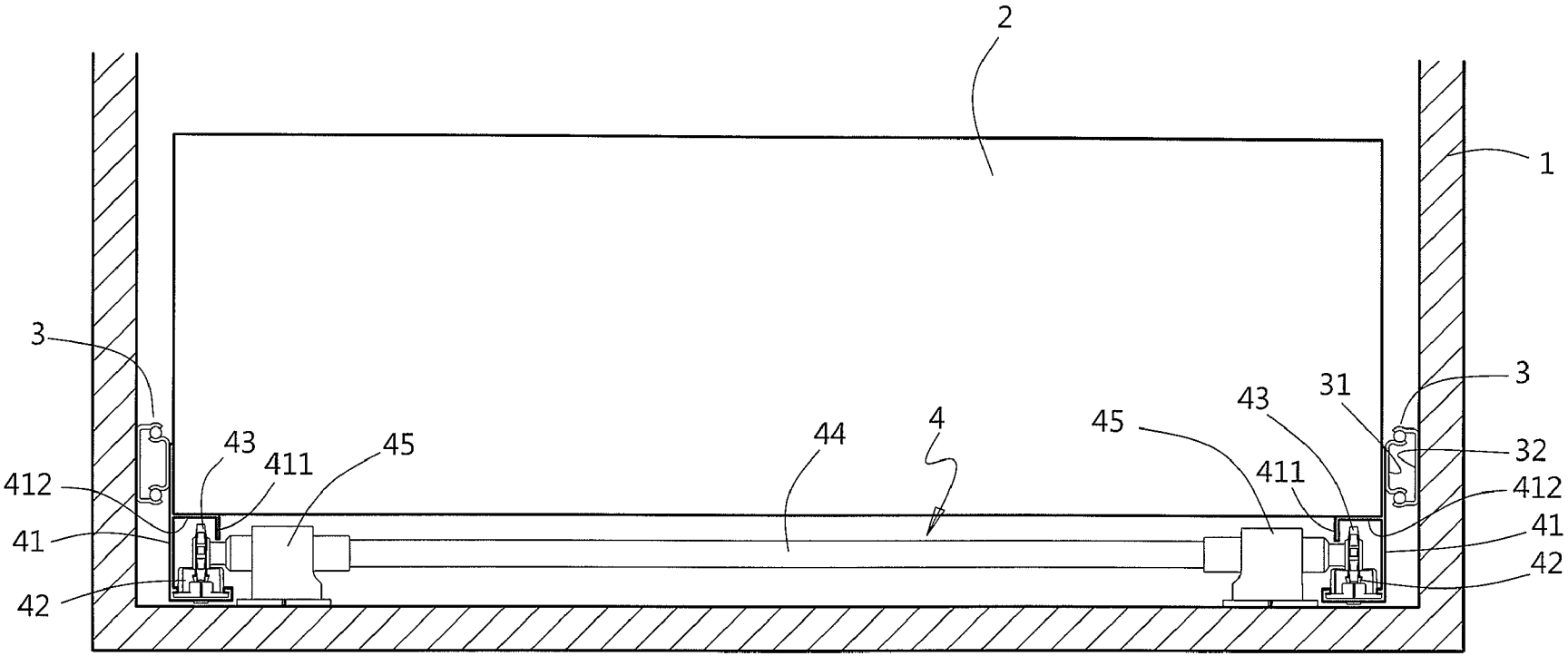
FIG. 1 is a front schematic view of a first embodiment of the present invention.
Figure 2:
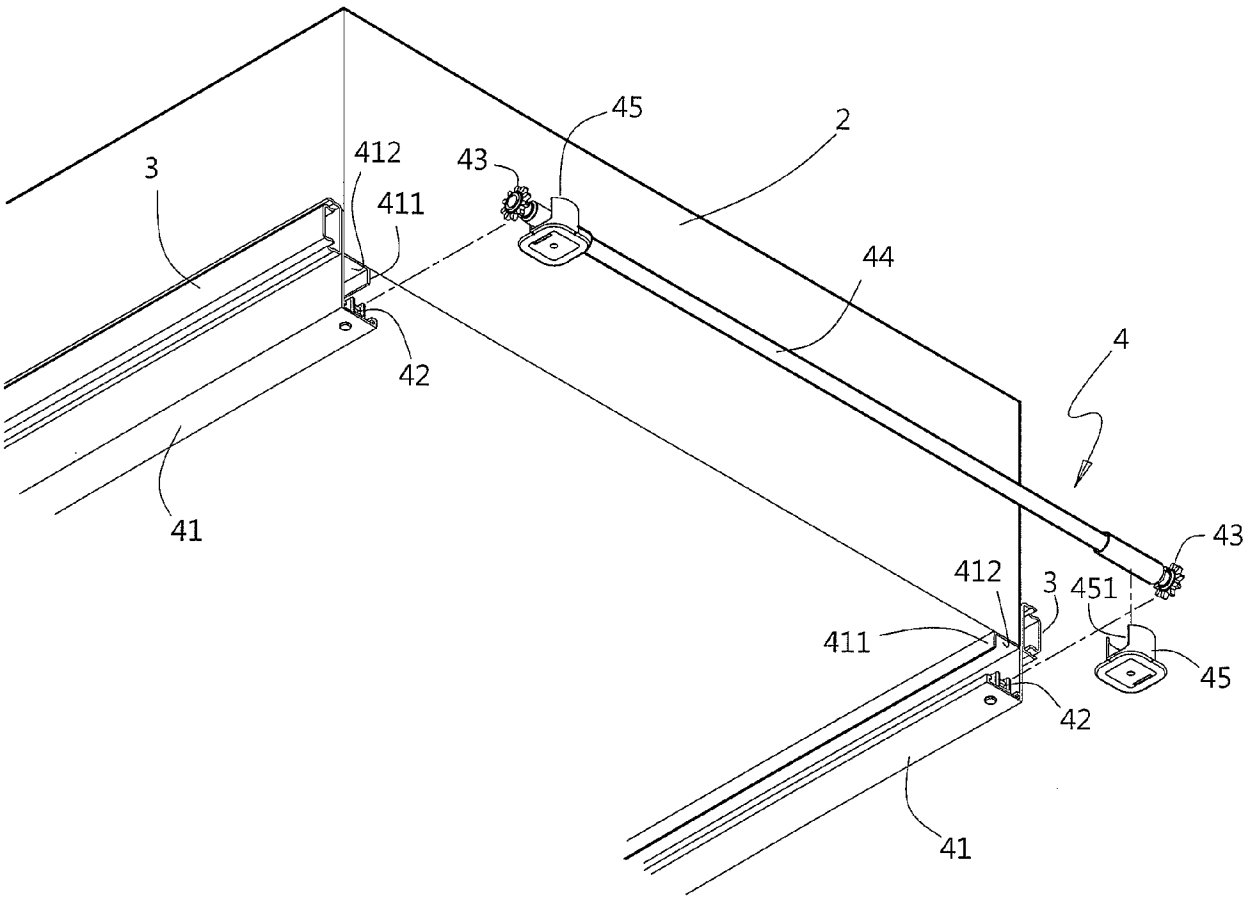
FIG. 2 is a partially exploded view of the first embodiment of the present invention.
Figure 3:
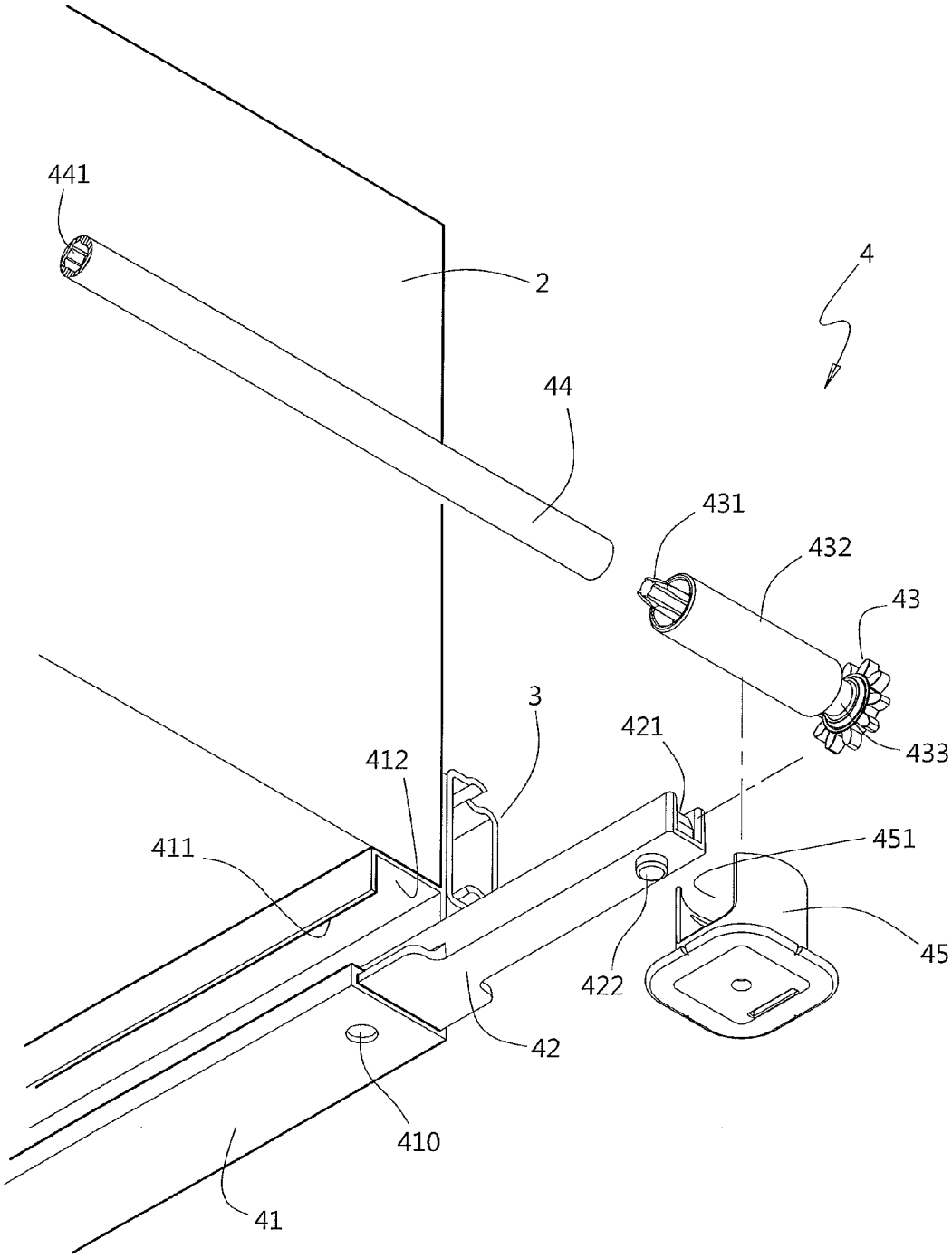
FIG. 3 is an enlarged partially exploded view of the first embodiment of the present invention.
Figure 4:
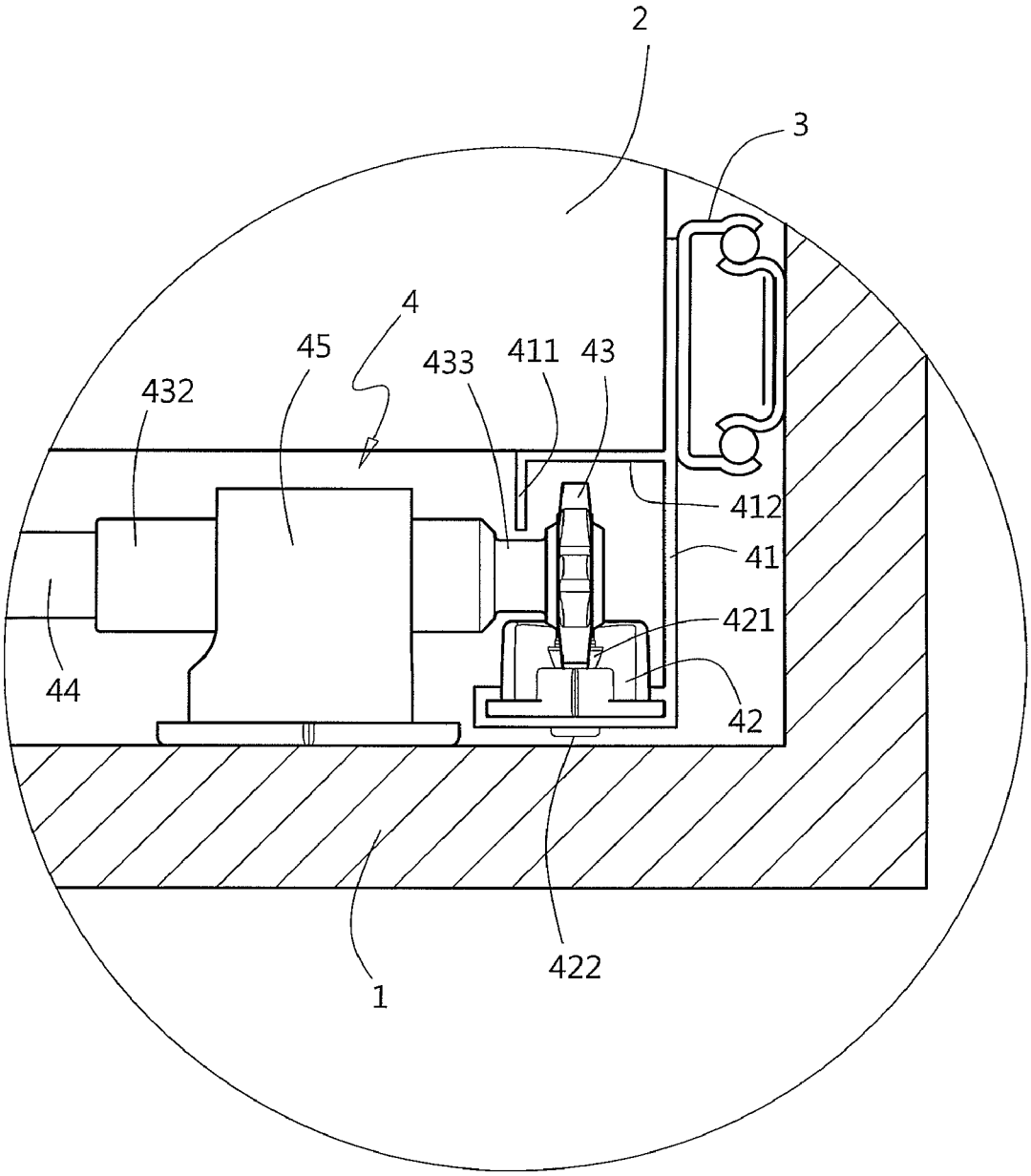
FIG. 4 is an enlarged partially front schematic view of the first embodiment of the present invention.

The present invention provides a stabilizing assembly of drawable carrier. Referring to FIGS. 1 through 4, a cabinet body 1 is installed with a predetermined number of drawable carriers (such as drawers, baskets, shelves, etc.), as one said drawable carrier 2 is provided in the presently shown embodiments. The drawable carrier 2 is configured to be pushed or drawn to slide into or out from the cabinet body 1. For this end, a drawer slide 3 is provided between each of two laterals of the drawable carrier 2 and the cabinet body 1. The drawer slide 3 includes a guiding member 31 fixed to the drawable carrier 2 and a sliding rail 32 fixed to the cabinet body 1 correspondingly so that the guiding member 31 and the sliding rail 32 mutually engage in a slidable and longwise extendable manner. In addition, a retaining device 4 is provided between a bottom of the drawable carrier 2 and the cabinet body 1. The retaining device 4 is composed of two rails 41 fixed to two laterals of the drawable carrier 2 and a rolling shaft rolling along the two rails 41. Therein, each of the rails 41 has a bottom embedded therein with a rack 42 that has a rack 421. The rack 42 further has a bottom equipped with a raised positioning portion 422, while the corresponding rail 41 has a positioning hole 410, so that when the positioning portions 422 are positioned by the positioning holes 410, the racks 42 engage with the rails 41 without shifting. Moreover, the rolling shaft includes two gears 43 that are configured to engage with the racks 421 and settled at two ends of a rod 44. More particularly, each of the gears is mounted around a bush 432. The rod 44 has its two ends formed with toothed combining holes 441. Each of the bushes 432 has its end near the gear 43 formed as a tubular shape so as to define a well therein. The well is provided with a combining portion 431 to be fittingly received in the toothed combining hole 441, so that rod 44 and the gears 43 are mutually positioned both in the radially inward and outward directions, thereby limiting the gears 43 to slant with respect to the rod 44 and allowing the two gears 43 linked through the rod 44 to rotate simultaneously. Moreover, two retained portions 433 are formed on the bushes 432 near the two gears 43, respectively, while two opposite supporting seats 45 are provided on the cabinet body 1 facing the front bottom of the drawable carrier 2. The two bushes 432 connected to the two ends of the rod 44 are easily received in two top-opened long notches 451 each on a said supporting seat 45 while the bushes 432 are allowed to shift vertically in the long notches 451. In addition, a stop unit is provided on the rails 41 toward the bushes 432 facing the racks 421 on the rails 41. The stop unit herein includes two stop portions 411 each first extending horizontally from a top portion of the rail 41 near the gear 43, then extending vertically downward to cover the gear's top and one lateral, and further extending vertically downward. The stop portion 411 has a terminal separated from the retained portion 433 of the bush 432 by a predetermined distance.

Thereby, when the drawable carrier 2 receives a force that makes it get drawn out from or pushed into the cabinet body 1, the sliding drawable carrier 2 is guided by not only the drawer slides 3 but also the retaining device 4. The engagements between the racks 421 at the two literals of the drawable carrier 2 and the set vertically, rotating simultaneously, gears 43 orient and guide the sliding drawable carrier 2 without swing and deviation so as to achieve smoother slide of the drawable carrier 2. On the other hand, when the drawable carrier 2 is drawn or pushed at one of the lateral edges of its façade furthest from the center, the drawable carrier 2 will move with one side seriously exceeding the other side. Consequently, the engagements between the two gears 43 and the racks 421 receive unbalanced components of force, and the gears 43 may disengage from the racks 421. Especially, when the drawable carrier 2 is big and bulky, such disengagement is more likely to happen. Structurally, the gears 43 might be stopped by the bottom of the drawable carrier 2 or a ceiling 412 of the rails 41 from escaping. However, for allowing the gears 43 to rotate smoothly, a relatively large distance is left between the gear 43 and the ceiling 412, so when the force exerted on the drawable carrier 2 is significantly unbalanced, the two gears 43 can repeat the process of climbing teeth of the racks 421 to derail and getting retained by the ceiling 412 to return to the racks 421. Consequently, continuous moving the drawable carrier 2 makes the gears 43 keep jogging, in turn making tooth tops of the gears 43 intermittently ram the ceiling 412, which brings about undesired noise.

Thus, for further preventing the jog of the gears 43 and the consequent noise, the present invention is such configured that the distance between the terminal of the stop portion 411 of the rail 41 and the retained portion 433 of the bush 432 is much smaller than the distance between the upmost tooth of the gears 43 and the ceiling 412. Thereby, when the drawable carrier 2 receives unbalanced force and disengagement between the gears 43 and the racks 421 happens, the terminal of the stop portion 411 stops the retained portion 433 (or the bush 432) so that the gear 43 is prohibited from jogging and in turn contacting the ceiling 412. Besides, since the retained portion 433 (or the bush 432) has a round sectional shape, the retained portion 433 and the terminal of the stop portion 411 are in smooth contact, and no intermittent impacting noise can thus occur. Additionally, since the vertically extending segment of the stop portion 411 covers the exposed lateral of the gear 43, the engagement between the gears 43 and the racks 421 is ensured, so the drawable carrier 2 is allowed to slide along the set direction stably and smoothly, thereby preventing deviation of the drawable carrier 2 and consequent noise.

Figure 5:
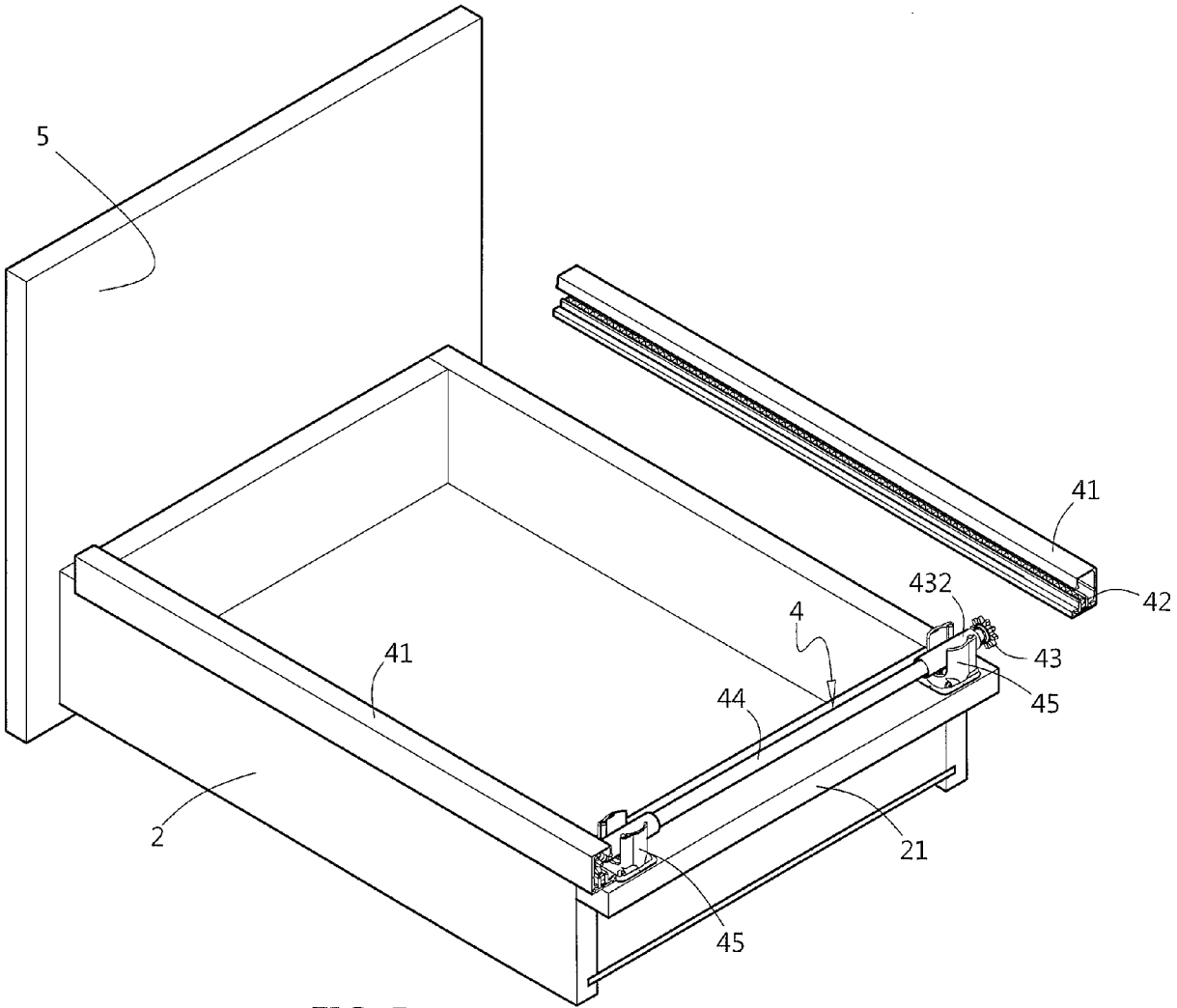
FIG. 5 is a perspective view of a second embodiment of the present invention.
Figure 6:
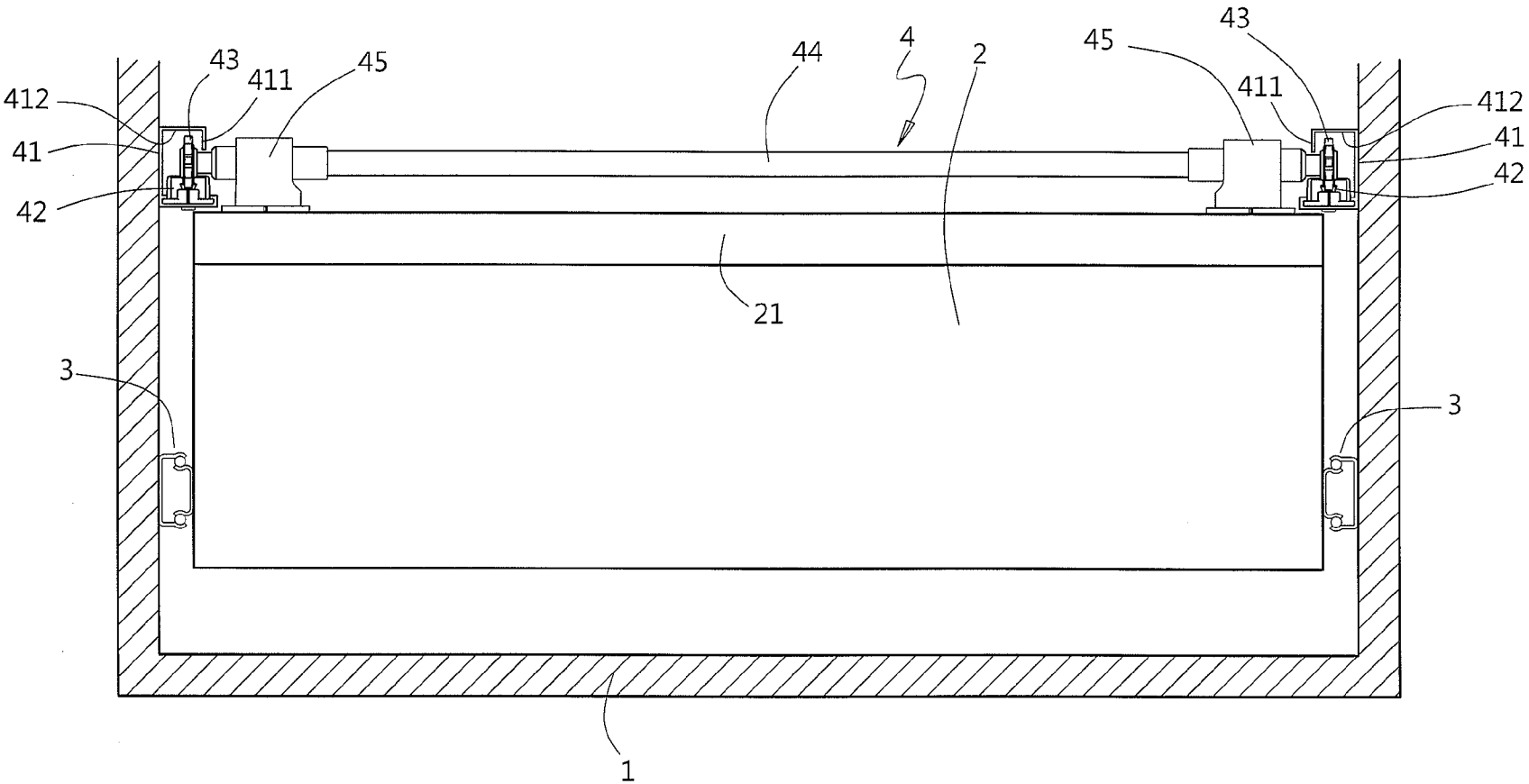
FIG. 6 is a schematic drawing of the second embodiment of the present invention.
Figure 7:
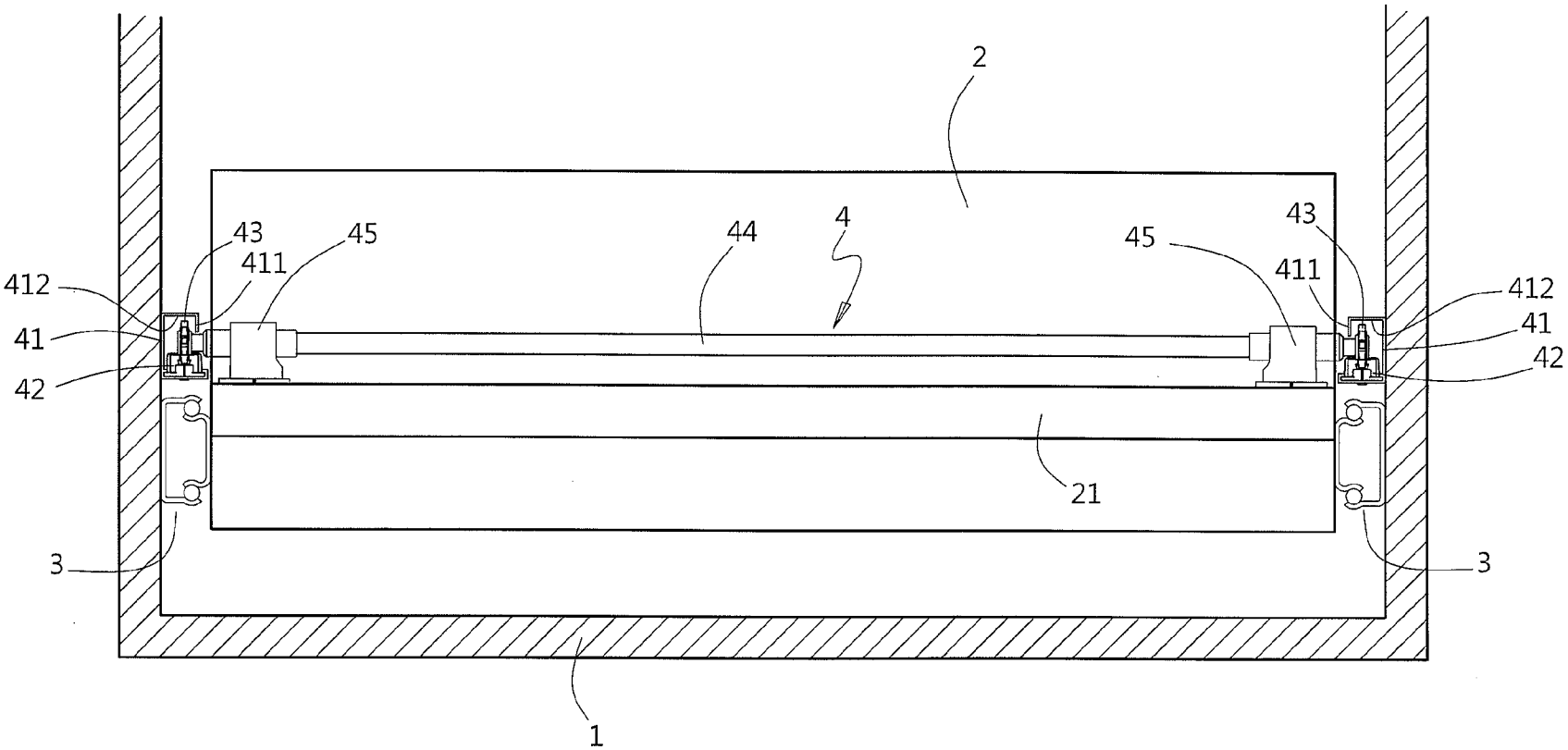
FIG. 7 is a schematic drawing of a third embodiment of the present invention.

While the retaining device 4 is settled below the drawable carrier 2, the assembly may be arranged above the drawable carrier 2 at a rear end of the drawable carrier 2, as shown in FIGS. 5 and 6. In this alternative embodiment, two rails 41 with racks 421 are fixed to two laterals of the cabinet body 1 while the bushes 432 connected to two ends of a rod 44 of the rolling shaft are received in two supporting seats 45 at the back of the drawable carrier 2. The supporting seats 45 are fixed to two fixing seats 21 settled at the upper back of the drawable carrier 2. In addition, a stop portion 411, acting as the stop unit, extends downward from the rail 41 with a terminal thereof extending toward a side of the bush 432 opposite to another side of the bushes 432 facing the rack 421 on the rail 41 closely adjacent to the retained portion 433. Alternatively, as shown in FIG. 7, two rails 41 having racks 421 are fixed to the two opposite laterals of the cabinet body 1, and two supporting seats 45 receiving the bushes 432 of the rolling shaft are positioned by two fixing seats 21 fixed to the back of the drawable carrier 2. Similarly, a stop portion 411, acting as the stop unit, extends first horizontally from a top portion of the rail 41 near the gear 43 toward a side of the bush 432 opposite to another side of the bushes 432 facing the rack 421, then extending vertically downward to cover the gear's top and one lateral, and further extending vertically downward to have a terminal closely adjacent to the retained portion 433 of the bush 432.

The invention claimed is:

1. A stabilizing assembly of a drawable carrier installed in a cabinet body, the stabilizing assembly having a retaining device arranged between the cabinet body and the drawable carrier and configured to orient and stabilize the drawable carrier when the drawable carrier is sliding, with the retaining device comprising:

two rails correspondingly arranged between the cabinet body and two laterals of the drawable carrier, respectively, with each said rail having a rack; and a rolling shaft moving along the two rails and including two gears that engage with the two racks, respectively, wherein the two gears are connected to each other by a rod so as to rotate simultaneously, wherein two bushes are respectively arranged near the two gears and are respectively received in two corresponding supporting seats;

two retained portions formed on the bushes near the two gears, respectively, with each rail having a ceiling corresponding to the rack and slightly higher than a top of the gear; and a stop portion extending vertically downward from the ceiling near an end of the bush to cross the top of the gear and further extending downward along a lateral of the gear to be closely adjacent to the retained portion.

2. The stabilizing assembly of claim 1, wherein a distance between a terminal of the stop portion and the retained portion is smaller than a distance between the ceiling and the top of the gear.

3. The stabilizing assembly of claim 1, wherein the two rails are fixed to the two laterals of the drawable carrier, respectively.

4. The stabilizing assembly of claim 1, wherein the two rails are fixed to two laterals of the cabinet body, respectively.

5. A stabilizing assembly of a drawable carrier having a retaining device, with the retaining device comprising:

a rail having a rack; and a rolling shaft moving along the rail and including a gear engaged with the rack, wherein the gear is connected to a rod to rotate simultaneously therewith, wherein a bush is arranged near the gear and received in a supporting seat; and a retained portion formed on the bush near the gear, with the rail having a ceiling corresponding to the rack and slightly higher than a top of the gear, with the ceiling having a portion near the bush and having a vertical surface extending downward to form a stop portion extending across the top of the gear and further extending downward along a lateral of the gear to be closely adjacent to the retained portion.

6. The stabilizing assembly of claim 5, wherein a distance between a terminal of the stop portion and the retained portion is smaller than a distance between the ceiling and the top of the gear.

7. The stabilizing assembly of claim 6, wherein the rail is fixed to a lateral of the drawable carrier.

8. The stabilizing assembly of claim 6, wherein the rail is fixed to a lateral of a cabinet body.

* * * * *